US006102842A

United States Patent [19]

Harris, Jr.

[11] Patent Number: 6,102,842

[45] Date of Patent: Aug. 15, 2000

[54] ADJUSTABLE CONTINUOUS FORMS PAPER STACKER

[76] Inventor: Walter E. Harris, Jr., 101 May Morning Ct., Lexington, S.C. 29073

[21] Appl. No.: 09/047,675

[22] Filed: Mar. 25, 1998

Related U.S. Application Data

[60] Provisional application No. 60/058,244, Sep. 8, 1997.

[51] Int. Cl.[7] ..... B65H 45/101

[52] U.S. Cl. ..... 493/410; 493/412; 493/411; 493/439

[58] Field of Search ..... 493/409, 410, 493/412, 439, 411, 413, 414; 242/615.21, 615.3, 615.4; 226/196, 199

[56] References Cited

U.S. PATENT DOCUMENTS

| | | | |
|---|---|---|---|
| 1,078,569 | 11/1913 | Ackerman . | |
| 1,449,750 | 3/1923 | Hampshire et al. . | |
| 2,061,595 | 11/1936 | Sherman . | |
| 2,906,527 | 9/1959 | Blain | 493/411 |
| 3,107,836 | 10/1963 | Veld | 226/196 |
| 3,278,178 | 10/1966 | Eckl . | |
| 3,514,096 | 5/1970 | Muller . | |
| 4,226,410 | 10/1980 | McIntosh, Sr. et al. | 493/410 |
| 4,428,521 | 1/1984 | Rich et al. | 226/199 |
| 4,597,752 | 7/1986 | Muller et al. . | |
| 4,721,295 | 1/1988 | Hathaway | 493/412 X |
| 4,846,454 | 7/1989 | Parkander | 493/412 X |
| 4,860,904 | 8/1989 | Williams . | |
| 4,976,391 | 12/1990 | Jessen et al. | 226/196 |
| 5,030,192 | 7/1991 | Sager | 493/411 X |
| 5,074,836 | 12/1991 | Fechner et al. . | |
| 5,074,837 | 12/1991 | Blanton, III et al. . | |
| 5,078,383 | 1/1992 | Shiina et al. . | |
| 5,110,111 | 5/1992 | Gompertz et al. . | |
| 5,123,893 | 6/1992 | Grooms . | |
| 5,149,075 | 9/1992 | Crowley et al. | 493/411 X |
| 5,238,316 | 8/1993 | Moore et al. | 493/410 X |
| 5,240,243 | 8/1993 | Gompertz et al. . | |
| 5,363,998 | 11/1994 | Tschiderer . | |
| 5,603,683 | 2/1997 | Lee et al. . | |
| 5,642,951 | 7/1997 | Belizario . | |

FOREIGN PATENT DOCUMENTS

| | | | |
|---|---|---|---|
| 1288218 | 9/1972 | United Kingdom | 493/410 |

*Primary Examiner*—David A. Scherbel
*Assistant Examiner*—Anthony Ojini
*Attorney, Agent, or Firm*—Michael A. Mann; Michael E. Wever; Nexsen Prutet Jacobs and Pollard

[57] ABSTRACT

A continuous fan folded paper stacker that is easily adjustable to stack various sizes of forms comprising a base, guide arm and receiving platform. The guide arm acts in conjunction with the platform to allow stacking of various sized forms. The Z-shaped guide arm may be vertically adjusted with respect to the base and may be inverted to accommodate smaller than standard sized paper. The L-shaped platform works in conjunction with the guide arm by sliding horizontally with respect to the base to neatly stack different sizes of paper.

18 Claims, 2 Drawing Sheets

26
10
44
θ
54
46
66
26
52
50
52
τ
42
64
48
30
32
28
62
34
28

ADJUSTABLE CONTINUOUS FORMS PAPER STACKER

This application claims the benefit of the filing date of provisional application Ser. No. 60/058,244, filed Sep. 8, 1997.

1. FIELD OF THE INVENTION

The present invention relates generally to an apparatus for stacking fan-folded continuous forms paper, and more particularly, to an apparatus that will reliably stack different sizes of fan-folded paper while still minimizing stacking failures.

2. BACKGROUND OF THE INVENTION

In every office, school and home, computer users want tools which save time and effort. Printers have increased in speed and clarity of print. Networked computers may not be in the same location as the printer that serves them. Consequently, the user must rely on a printer that may not be convenient to watch as it prints. If the printer is printing on fanfold paper, there is the possibility, indeed, the inevitability of paper failing to fold along the perforations as intended. When such a printer is not being watched, the results can be a stack of paper where much of it is folded the wrong way or where portions are bent. The time to refold fanfold paper that has not stacked as it should is wasted time.

The use of fan-folded continuous paper is well known for its ability to allow fast printing while minimizing its handling upon discharge from a printer. Continuous fan folded paper helps increase the time between adding paper to the printer since a large box of continuous fan folded paper can feed to a printer and the use of a continuous web decreases handling of documents. The term fan folded continuous paper refers to a continuous web of paper with regularly spaced perforated sheets such that the web may be put into a neat stack by folding it along the perforated lines. Although fan-folded continuous paper normally comes in standard 8½ by 11 inches, other forms are routinely of shorter length.

Although using continuous fan folded paper decreases output handling, assistance is still required to limit stacking failures. Ideally, continuous fan folder paper may be used by a user or group of users to print several different documents while the output of the printer stacks the paper upon discharge. At a time of the user's choosing, he may pick up his document from a stack and separate his document by tearing the sheets that he wants from those remaining.

Several attempts have been made to recreate the neat stack of continuous fan-folded paper upon discharge from a printer. Printer operators have resorted to manually refolding the first few sheets in hopes that the subsequent sheets will continue in a neat stack. Moreover, apparatuses have been designed to collect and stack the paper upon discharge from the printer. However, none of the present devices for stacking continuous fan folded paper allow for both standard and short forms in a single device. There exists a need for an adjustable apparatus which does not require operator assistance and may stack different length forms.

SUMMARY OF THE INVENTION

According to its major features and briefly stated, the present invention is an adjustable apparatus for refolding fan-folded continuous forms of different lengths. The device basically consists of three elements: a base, an adjustable receiving platform and an adjustable, reversible guide arm. The base is a bin into which the neatly stacked paper is housed. The platform and guide arm work in conjunction to facilitate the stacking of both standard and small forms.

A major feature of the present invention is the cooperation of the adjustable receiving platform and reversible, adjustable guide arm. Used in conjunction, the apparatus works effectively with smaller forms as with the standard 8½ by 11 inches. This feature creates a major advantage over the prior art in its ability to handle varying sizes of forms. Moreover, the device is easily adapted to stack small forms.

Another important feature of the present invention is its reversible Z-shaped guide arm. The guide arm being designed in a Z-shape is important to this invention because it allows a single guide arm to be used for both larger and smaller forms. The guide arm is designed so that it may be easily reversed for changing to a different form size.

Still another important advantage of the present invention is its ability to provide reliable stacking without assistance. The stacker is designed so that no assistance is required from users upon discharge from a printer. The device is passive in this way, such that a neat stack of paper will automatically result from the device when properly adjusted for the paper it is to receive.

Other features and their advantages will become apparent to those skilled in the art from a careful reading of the Detailed Description of Preferred Embodiments accompanied by the drawings.

DETAILED DESCRIPTION OF PREFERRED EMBODIMENT

Figure 1:
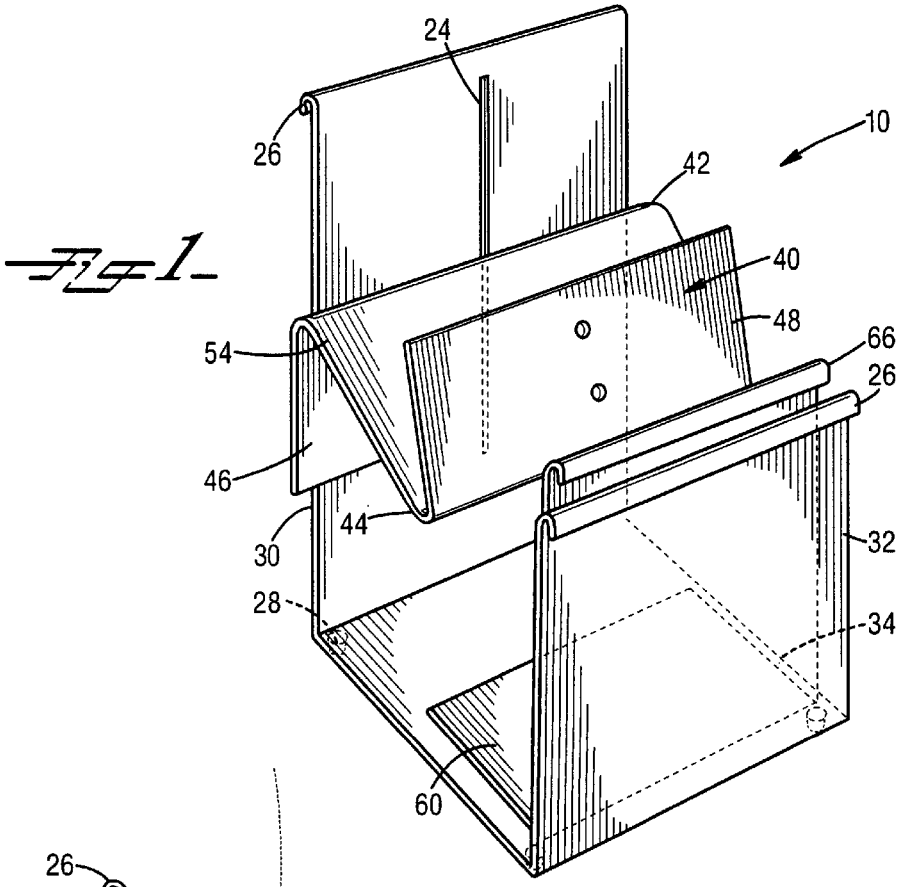
FIG. 1 is a perspective view of a stacker according to a preferred embodiment of the present invention.
Figure 2:
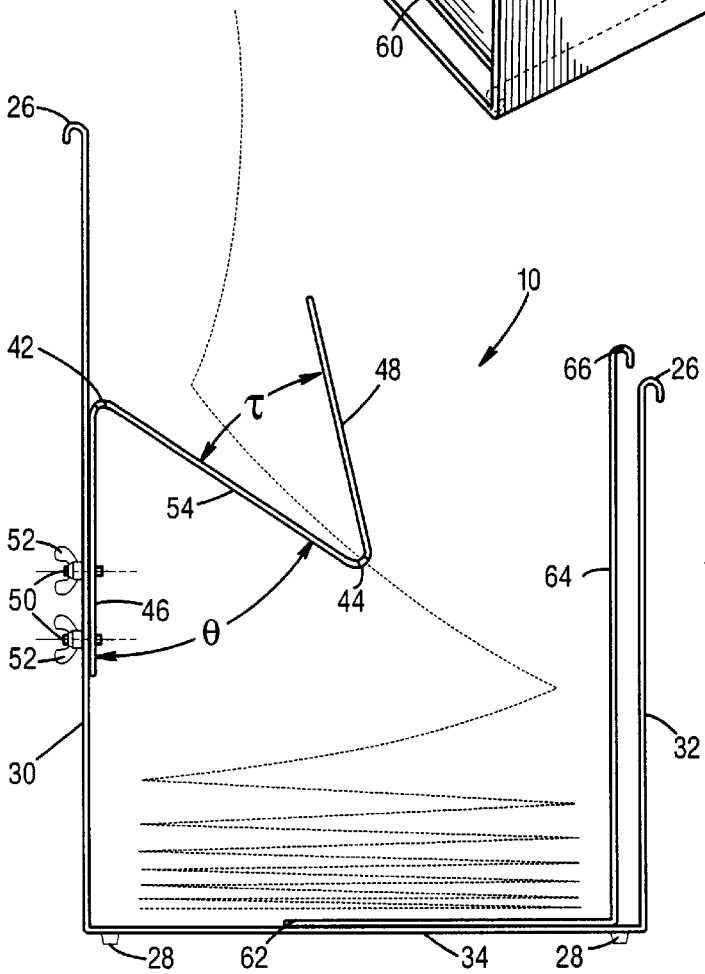
FIG. 2 is a side view of a stacker according to a preferred embodiment of the present invention showing the guide arm in position for stacking standard size paper with paper illustrated in ghost.
Figure 3:
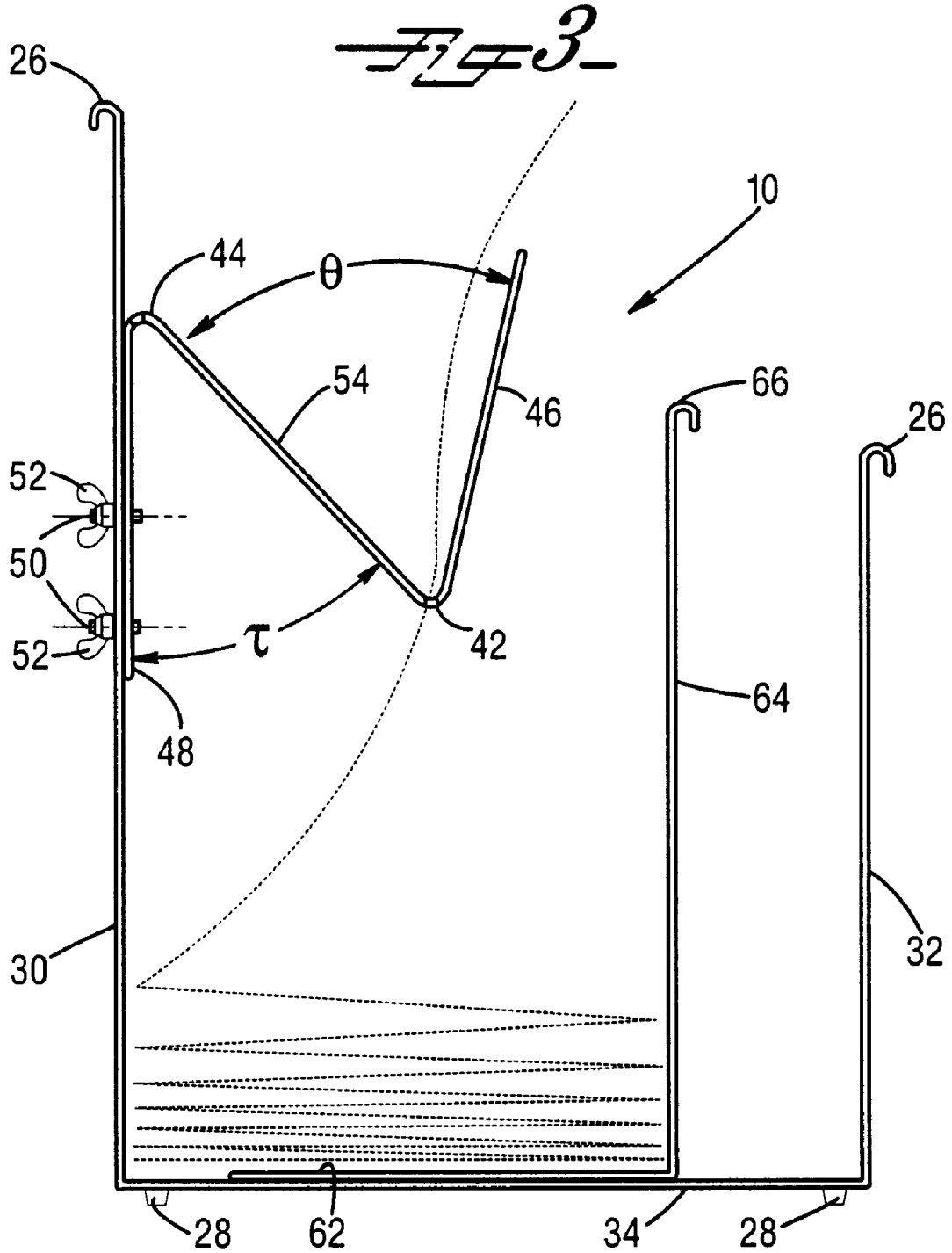
FIG. 3 is a side view of a stacker according to a preferred embodiment of the present invention showing the guide arm in position for stacking small size paper with paper illustrated in ghost.

The present invention is a device for receiving and stacking continuous fan-folded paper. Referring to FIGS. 1–3, there is shown in perspective view, the invention in its preferred embodiment. The stacker 10 includes a U-shaped base, adjustable, reversible Z-shaped guide arm 40, and adjustable L-shaped receiving platform 60 each of which is preferably made of metal or plastic. For convenience when referring to the figures, the front side of the base will be referred to as the side with the guide arm 40. The base is of sufficient width to hold sheets of paper and need not be as wide as the paper; preferably, the bottom wall 34 is 11¾ inches by 10 inches. Both the front wall 30 and the back wall 32 of the base have handles 26 formed on top. Preferably, the handles 26 are curved outward from the base by one inch. Although one wall may be taller for positioning purposes, this is not necessary. In the preferred embodiment, the back wall 32 is 10 inches square while the front wall 30 is 16 inches by 10 inches. The front wall 30 contains a slit 24 for adjusting the position of the guide arm 40. The slit 24 is preferably positioned in the center near the top of the front wall 30 and is preferably 11 inches by 9/32 inch. The exact length of the slit 24 is not critical to the stacker 10, but merely needs to be of sufficient length to adjust the height of guide arm 40 over a suitable operating range for smaller to larger stacks of paper. Attached to the bottom wall 34 is preferably four stops 28 positioned near the corners and made of suitable material to prevent the stacker 10 from sliding.

The guide arm 40 attaches to the front base wall 30 preferably using bolts 50 and wing nuts 52. The reversible guide arm 40 is designed to take different sized forms. The Z-shaped guide arm includes a small forms attachable plate 48 and a large forms attachable plate 46 connected by a support panel 54. Preferably, both the large forms plate 46 and the small forms plate 48 are 5 inches by 12¾ inches. The support panel 54 is preferably 6½ inches by 12¾ inches. A small forms slit 42 and a large forms slit 44 are positioned at the connection of the supporting panel and large forms plate and the small forms plate, respectively. Both the small forms slit 42 and large forms slit 44 are preferably 10¼ inches by ¾ inch to easily allow the standard 8½ inch width paper pass through.

The small forms plate 48 is designed so that the angle between it and the support panel 54 is smaller than the angle between the large forms plate 46 and the support panel 54. Referring to FIG. 2, using the large forms plate 46, the angle 0 is larger than τ allowing the forms to be positioned farther from the front base wall 30 using large forms slit 44; while using the small forms plate 48, the paper is positioned closer to the front base wall 30 using small forms slit 42. For using shorter forms the small forms plate 48 should be attached to the front base wall 30, but the large forms plate 46 should be attached to the front base wall 30 for handling larger forms. The guide arm 40 may be adjusted vertically by loosening the wing nuts 52 and then tightening the wing nuts 52 when the guide arm is in the desired position.

The L-shaped receiving platform 60 slidably rests on the bottom of base such that the horizontal member 62 is closer to the front wall 30 of base and vertical member 64 is closer to the back wall 32 of base. The top of the receiving platform 60 is shaped to form a handle 66 such that the platform 60 may be easily moved for receiving shorter forms. Preferably, the horizontal member 62 of receiving platform 60 is 7½ inches by 9 inches and vertical member 64 which is 13 inches by 9 inches. In operation, the platform 60 can be moved closer to the front wall 30 of base for receiving shorter forms such that the forms come to rest upon the platform 60 and are neatly stacked by the vertical member 64.

In use, stacker 10 is preferably placed below and near the printer (not shown) so that the printed paper falls into guide arm 40 from either direction but preferably from front wall 30 to back wall 32. In other words, the stacker 10 may be oriented either to receive paper from the front wall 30 or from the back wall 32. The guide arm 40 will be oriented to accommodate the type of fan fold paper being received and secured using bolts 50 and wing nuts 52. If the paper is standard 8½ by 11, then the large forms plate 46 of guide arm will be attached to the front wall 30 of base using bolts 50 and wing nuts 52. In conjunction with the orientation of the guide arm 40, the platform 60 will be moved toward the back wall 32 to promote neat stacking. If the paper is shorter, then the guide arm 40 will be oriented such that the small forms plate 48 is attached to the front wall 30 using the bolts 50 and wingnuts 52. Along with the orientation of the guide arm 40, the platform 60 will be moved closer to the front wall 30 to neatly stack the paper. As can be seen, the platform 60 is moved either closer to or farther from back wall 32 depending on the length of form which is being stacked.

Support panel 54 cooperates with small forms plate 48 and large forms plate 46 to funnel paper toward the back corner of platform 60 toward slits 42, 44. Once through slits 42 or 44, depending on whether the guide is oriented for stacking small or large forms, the paper will be collected along the bottom of base. The platform will provide support for neat stacking as the paper will have a straight edge to rest against in the vertical member 64 of platform 60.

It will be apparent to those skilled in the art that many modifications and substitutions may be made to the preferred embodiments described above without departing from the spirit and scope of the invention, which is defined by the appended claims.

What is claimed is:

1. A device for stacking fanfold paper, said device comprising:

a base formed to receive fanfold paper, said base having a first corner and an opposing, second corner, said first and said second corners spaced apart by a distance sufficient to accommodate said fanfold paper; and a reversible arm carried by said base and having a slit formed therethrough into which said unfolded fanfold paper is funneled, said arm capturing and redirecting said unfolded fanfold paper through said slit and toward said first and second corners.

2. The device as recited in claim 1, wherein said paper has a length, and wherein said base is adjustable so that said distance between said first and second corners can be changed for receiving different lengths of said fanfold paper.

3. The device as recited in claim 1, wherein said paper has a length, and wherein said base further comprises an L-shaped receiving platform slidably carried by said base, said base having said first corner and said receiving platform having said second corner, said receiving platform slidable with respect to said base to adjust said distance between said first and said second corners for receiving different lengths of said fanfold paper.

4. The device as recited in claim 1, wherein said base has a front wall and said arm is carried by said front wall.

5. The device as recited in claim 4, wherein said front wall has a vertical slit formed therein, said arm being movable up and down along said slit, so that the spaced relation between said base and said arm is adjustable.

6. A device for stacking fanfold continuous paper, said device comprising:

a base having a first corner;

a receiving platform having a second corner, said first and second corners spaced apart by a distance, said receiving platform slidably secured to said base so that said distance can be adjusted to accommodate different sizes of fanfold paper; and a reversible arm carried by said based and having a slit formed therethrough into which said unfolded fanfold paper is funneled, said arm capturing and redirecting said unfolded fanfold paper through said slit and toward said first and second corners.

7. The device as recited in claim 6, wherein said paper has a length, and wherein said receiving platform is L-shaped.

8. The device as recited in claim 6, wherein said base has a front wall and said arm is carried by said front wall.

9. The device as recited in claim 8, wherein said front wall has a vertical slit formed therein, said arm being movable up and down along said slit, so that the spaced relation between said base and said arm is adjustable.

10. The device as recited in claim 6, wherein said arm is Z-shaped and has a small forms plate containing a first end and a second end, a large forms plate containing a first end and a second end, and a supporting member connecting said first end of said small forms plate with said second end of said large forms plate, said arm having slits formed therein where said small forms plate meets said supporting member and where said large forms plate meets said supporting member.

11. A device for stacking fan folded continuous paper, said apparatus comprising:

a base having a first corner and a second corner;

a receiving platform slidably engaging said base for receiving said paper in a stack; and a reversible Z-shaped arm carried by said base and in spaced relation to said base for funneling said paper wherein said arm captures said paper and redirects each page of said paper alternately, toward said first corner and said second corner of said base so that every other page of said paper is aligned.

12. The device as recited in claim 11, wherein said platform is L-shaped.

13. The device as recited in claim 11, further comprising means for lifting said base and means for lifting said platform.

14. The device as recited in claim 11, wherein said base has a front wall and a back wall, said base further having an arcuate lip formed on said back wall and said front wall for lifting said base.

15. The device as recited in claim 11, further comprising a handle carried by said base for lifting said base.

16. The device as recited in claim 11, wherein said platform has an arcuate lip formed thereon for moving said platform.

17. The device as recited in claim 11, wherein said platform has an arcuate lip formed thereon for moving said platform and wherein said base has a front wall and a back wall, said base further having an arcuate lip formed on said back wall and said front wall for lifting said base.

18. the device as recited in claim 11, wherein said device is formed from a material selected from the group consisting of metal and plastic.

* * * * *